US010189254B2

(12) United States Patent
Yokoyama et al.

(10) Patent No.: US 10,189,254 B2
(45) Date of Patent: Jan. 29, 2019

(54) DROPLET EJECTING HEAD AND DROPLET EJECTING APPARATUS

(71) Applicant: TOSHIBA TEC KABUSHIKI KAISHA, Tokyo (JP)

(72) Inventors: Shuhei Yokoyama, Mishima Shizuoka (JP); Ryutaro Kusunoki, Mishima Shizuoka (JP); Ikuo Fujisawa, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/685,949

(22) Filed: Aug. 24, 2017

(65) Prior Publication Data

US 2018/0086077 A1 Mar. 29, 2018

(30) Foreign Application Priority Data

Sep. 23, 2016 (JP) ..... 2016-185045

(51) Int. Cl.
*B41J 2/14* (2006.01)

(52) U.S. Cl.
CPC .. *B41J 2/14233* (2013.01); *B41J 2002/14241* (2013.01); *B41J 2202/11* (2013.01)

(58) Field of Classification Search
None
See application file for complete search history.

(56) References Cited

U.S. PATENT DOCUMENTS

2014/0193309 A1* 7/2014 Still ..... B01L 3/0268 422/500
2014/0253640 A1 9/2014 Yokoyama et al.

FOREIGN PATENT DOCUMENTS

JP 2014-172292 9/2014

OTHER PUBLICATIONS

IP.com search.*
U.S. Appl. No. 15/176,265, filed Jun. 8, 2016 (First Inventor: Ryutaro Kusunoki).

* cited by examiner

*Primary Examiner* — Lisa M Solomon
(74) *Attorney, Agent, or Firm* — Patterson & Sheridan, LLP

(57) ABSTRACT

A droplet ejecting head includes a board, a pressure chamber, a nozzle, and an actuator configured to cause a pressure change in the pressure chamber in response to an electrical signal supplied from a drive circuit. The drive circuit is configured to set the electrical signal at a first voltage level, change the electrical signal to a second voltage level, set the electrical signal to a third voltage level during a time period after changing the electrical signal from the first voltage level to the second voltage level, the time period being equal to a primary natural oscillation period of the actuator when the pressure chamber and the nozzle are filled with solution, and set the electrical signal to the first voltage level after the time period has elapsed. The third voltage level is between the first and second voltage levels or equal to the second voltage level.

20 Claims, 11 Drawing Sheets

DROPLET EJECTING HEAD AND DROPLET EJECTING APPARATUS

CROSS-REFERENCE TO RELATED APPLICATION

This application is based upon and claims the benefit of priority from Japanese Patent Application No. 2016-185045, filed Sep. 23, 2016, the entire contents of which are incorporated herein by reference.

FIELD

Embodiments described herein relate generally to a droplet ejecting head and a droplet ejecting apparatus.

BACKGROUND

Fluid dispensing in a range of picoliters (pL) to microliters (μL) is often used in biological and pharmaceutical research and development, medical diagnosis and examination, or agricultural testing. For example, in studying a dose-response effect of chemotherapy, fluid dispensing with a low volume is an important task for determining the concentration of a candidate compound required to effectively attack cancer cells.

In such dose-response experiments, candidate compounds are prepared at many different concentrations in the micro-sized wells of a multi-well plate to determine an effective concentration. An existing on-demand type droplet ejecting head is used for the above application. For example, the droplet ejecting head includes a storage container that holds a solution, a nozzle that ejects the solution, a pressure chamber that is disposed between the container and the nozzle, and an actuator that controls pressure of the solution inside the pressure chamber to eject the solution from the nozzle.

In the droplet ejecting head, the volume of one droplet ejected from an individual nozzle is on the order of a picoliter (pL). By controlling the total number of droplets ejected into each well, the droplet ejecting head supplies an amount of fluid in a range of picoliter to microliters into each well. Therefore, the droplet ejecting head is generally suitable for dose-response experiments when dispensing the candidate compounds at various concentrations or when dispensing in very small amounts.

The actuator in the droplet ejecting head can be a piezoelectric actuator that has a structure having a nozzle that ejects droplets.

DETAILED DESCRIPTION

Figure 1:
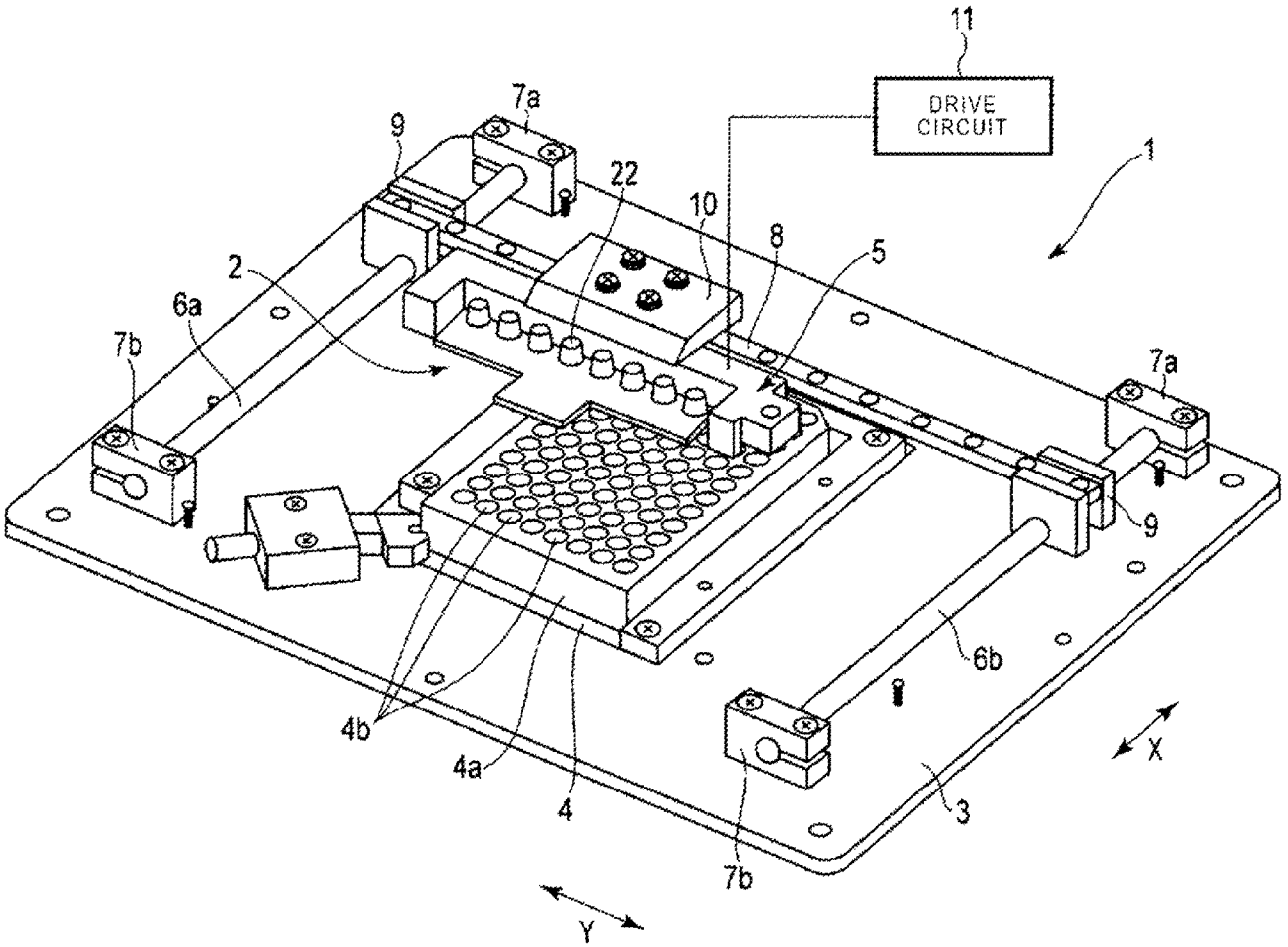
FIG. 1 is a schematic perspective view of a droplet ejecting apparatus including a droplet ejecting head according to an embodiment.

A droplet ejecting head includes a board having a first surface and a second surface, a pressure chamber in the board and having an opening on a first surface side of the board through which a solution can be supplied to the pressure chamber, a nozzle through which solution supplied from the pressure chamber can be ejected, the nozzle being disposed on a second surface side of the board opposite the first surface side, an actuator configured to cause a pressure change in the pressure chamber in response to an electrical signal supplied from a drive circuit by changing a volume of the pressure chamber, and a solution holding container on the first surface side of the board, the solution holding container having a solution inlet for receiving solution and a solution outlet for supplying solution to the pressure chamber via the opening. The drive circuit is configured to set the electrical signal at a first voltage level at a start of a droplet ejection process for ejecting solution through the nozzle, change the electrical signal from the first voltage level to a second voltage level during the droplet ejection process, set the electrical signal to a third voltage level during a time period after changing the electrical signal from the first voltage level to the second voltage level, the time period being equal to a primary natural oscillation period of the actuator when the pressure chamber and the nozzle are filled with solution, and set the electrical signal to the first voltage level after the time period has elapsed. The second voltage level when applied to actuator causing the pressure chamber to expand in volume from a volume of the pressure chamber when the first voltage level is applied to the actuator, and the third voltage level being in a range between the first voltage level and the second voltage level or equal to the second voltage level.

Hereinafter, example embodiments will be described with reference to the drawings. Each drawing is a schematic view for illustrating the embodiments and facilitating understanding thereof. The shape, dimension, and ratio may be different from those of the actual one. Design thereof can be changed as appropriate.

In an existing droplet ejecting head, a nozzle is disposed through a piezoelectric actuator. Accordingly, a length of the nozzle is the same as a thickness of the actuator. For an efficient droplet ejection, it is desirable that the thickness of the actuator is thinner, such that the length of the nozzle is restricted.

When a compound dissolved in a highly volatile solution/solvent is dropped into a plurality of containers such as wells of a microplate, it is necessary to complete a dropping task in a short time to prevent the concentration of the compound being changed due to solution/solvent volatilization. Therefore, many attempts have been made to increase ejecting speed of the solution ejected from the nozzle.

However, with the short piezoelectric actuator in an existing droplet ejecting head, if any attempt is made to increase the ejecting speed of the solution from the nozzle, there is a possibility that an unintended solution will be ejected immediately after the intended solution is ejected. In this case, a problem arises in that the solution is dispensed at more than a target dropping amount.

An example of a droplet ejecting head and a droplet ejecting apparatus including the same will be described with reference to FIGS. 1 to 7.

Figure 2:
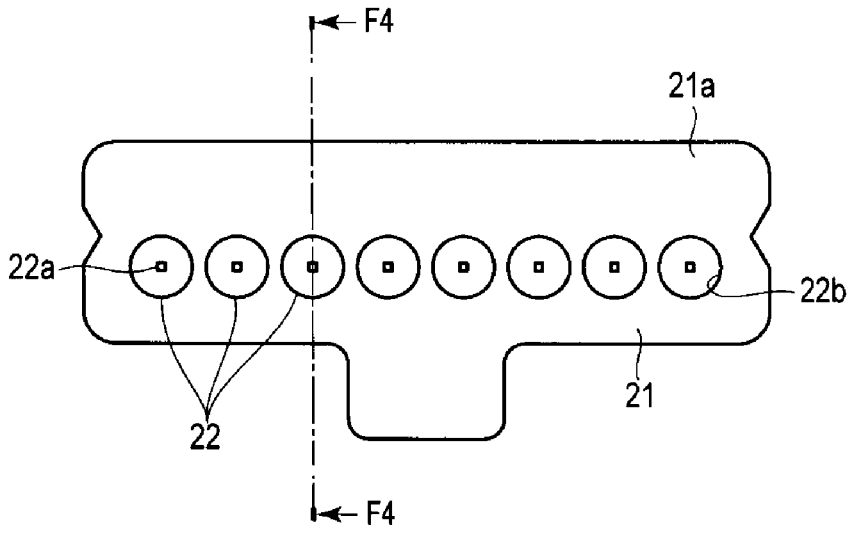
FIG. 2 is a top view of a droplet ejecting head.
Figure 3:
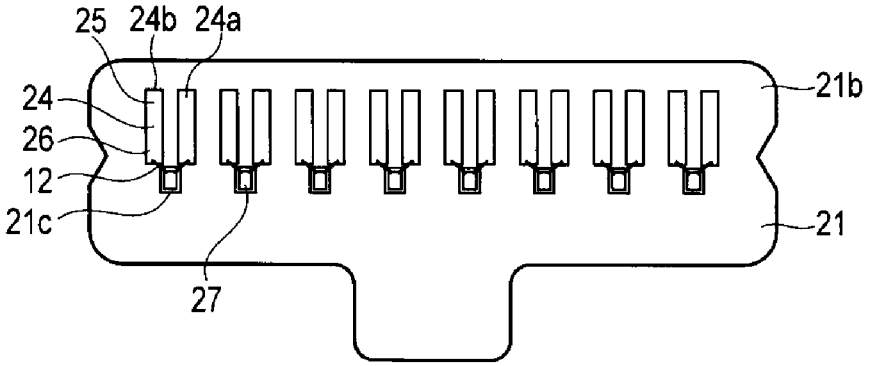
FIG. 3 is a bottom view of a droplet ejecting head.
Figure 4:
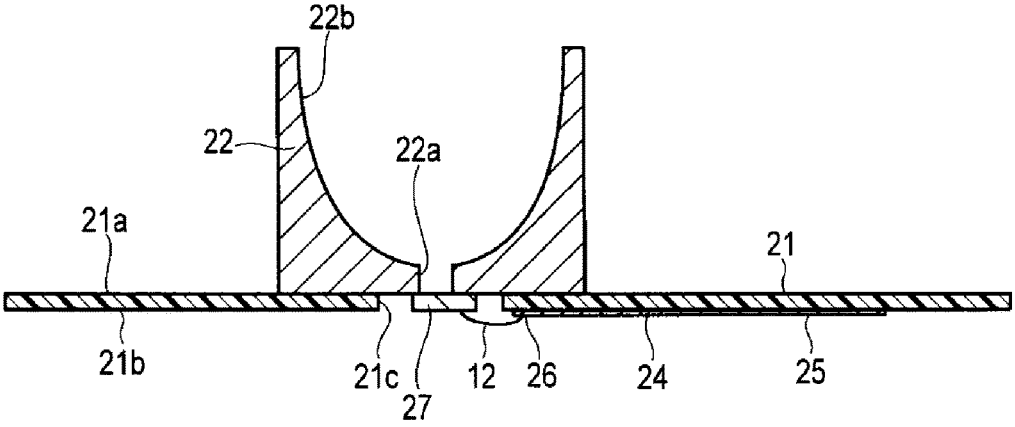
FIG. 4 is a longitudinal sectional view of the droplet ejecting head taken along line F4-F4 in FIG. 2.
Figure 5:
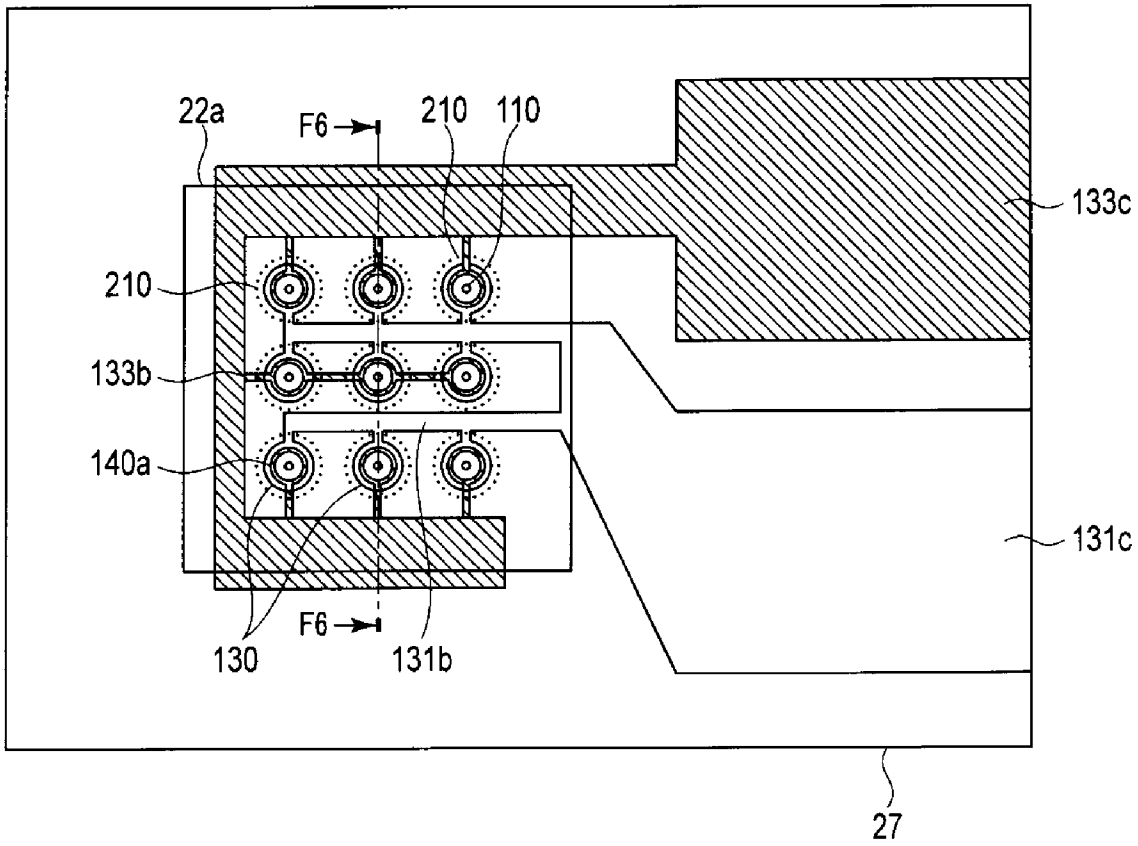
FIG. 5 is a plan view of a droplet ejecting array in a droplet ejecting head.
Figure 6:
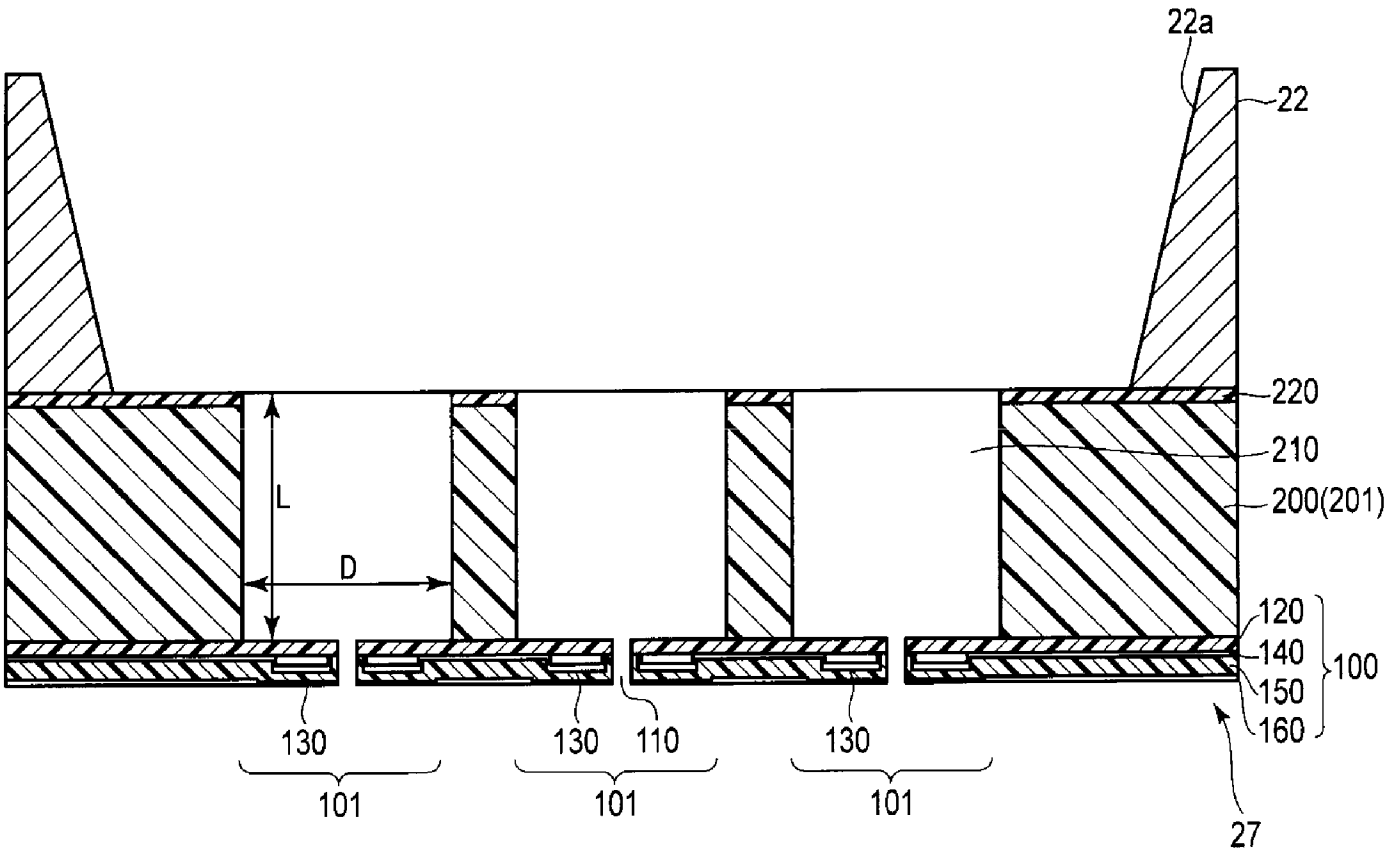
FIG. 6 is a longitudinal sectional view of the droplet ejecting head taken along line F6-F6 in FIG. 5.
Figure 7:
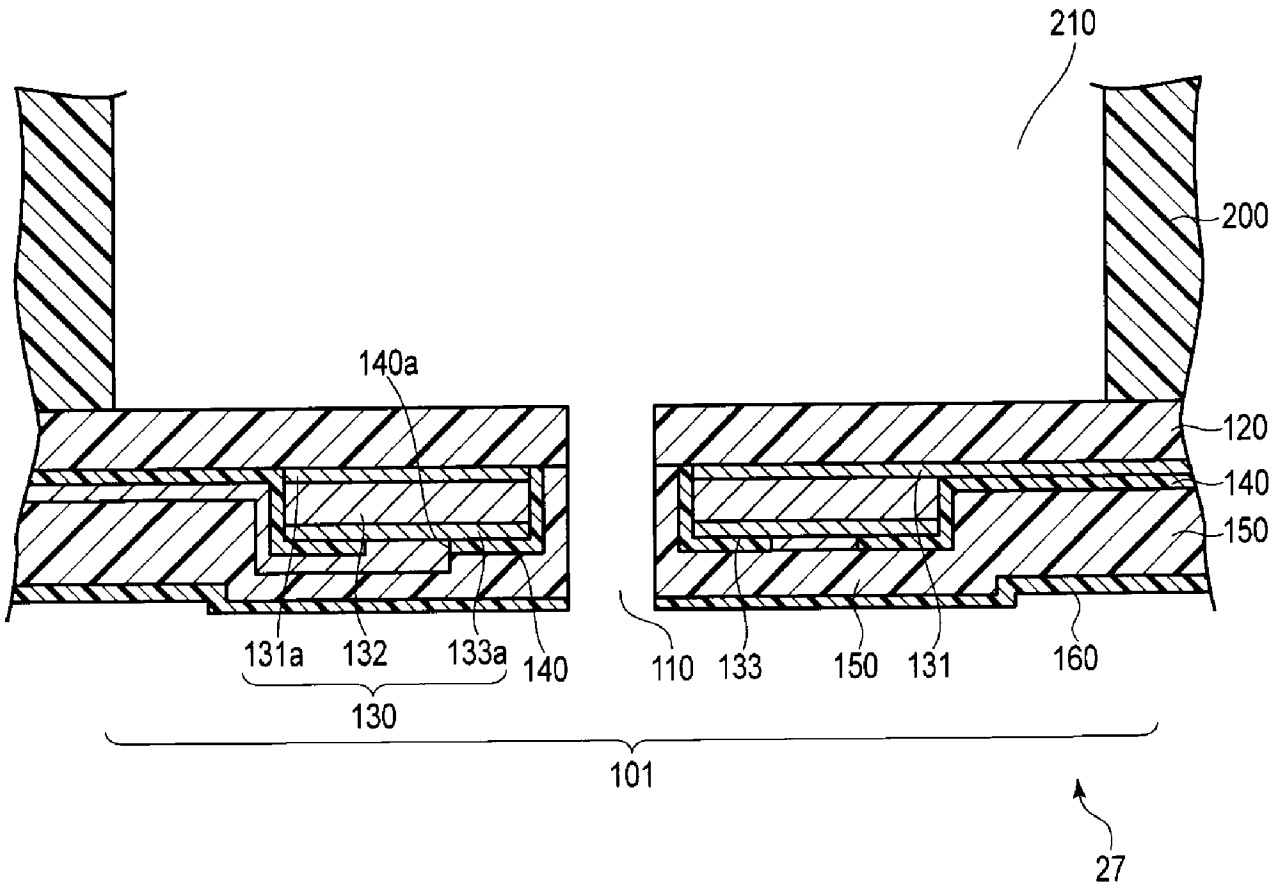
FIG. 7 is a longitudinal sectional view of an actuator structure in a droplet ejecting head.

FIG. 1 is a perspective view of a droplet ejecting apparatus 1 including a droplet ejecting head 2. FIG. 2 is a top view of the droplet ejecting head 2. FIG. 3 is a bottom view of a surface where the droplet ejecting head 2 ejects a droplet. FIG. 4 is a cross-sectional view taken along line F4-F4 in FIG. 2. FIG. 5 is a plan view of a droplet ejecting array 27 in the droplet ejecting head 2. FIG. 6 is a cross-sectional view taken along line F6-F6 in FIG. 5. FIG. 7 is a longitudinal sectional view of a nozzle 110 in the droplet ejecting head 2.

The droplet ejecting apparatus 1 has a rectangular plate-shaped base 3, a droplet ejecting head mounting module 5, and a drive circuit 11. In these examples, a solution is dropped into a microplate 4 having 96 wells. Such microplates are generally used for biochemical analysis or clinical examination.

The microplate 4 is fixed to the base 3. On either side of the microplate 4 on the base 3, right and left X-direction guide rails 6*a* and 6*b* extending in an X-direction are installed. Both end portions of the respective X-direction guide rails 6*a* and 6*b* are fixed to fixing bases 7*a* and 7*b* protruding on the base 3.

A Y-direction guide rail 8 extending in a Y-direction is installed between the X-direction guide rails 6*a* and 6*b*. Both ends of the Y-direction guide rail 8 are respectively fixed to an X-direction moving table 9 which can slide in the X-direction along the X-direction guide rails 6*a* and 6*b*.

A Y-direction moving table 10 is disposed on the Y-direction guide rail 8 and can move the droplet ejecting apparatus mounting module 5 in the Y-direction along the Y-direction guide rail 8. The droplet ejecting head mounting module 5 is mounted on the Y-direction moving table 10. The droplet ejecting head 2 is fixed to the droplet ejecting head mounting module 5. In this manner, an operation of the Y-direction moving table 10 moving in the Y-direction along the Y-direction guide rail 8 can be combined with an operation of the X-direction moving table 9 moving in the X-direction along the X-direction guide rails 6*a* and 6*b*. Accordingly, the droplet ejecting head 2 is supported so as to be movable to any position in XY-directions which are orthogonal to each other.

The droplet ejecting head 2 has a flat plate-shaped electrical board 21. As illustrated in FIG. 2, a plurality of (e.g., eight in these examples) solution holding containers 22 are juxtaposed along the Y-direction on a front surface side, also referred to as a first surface 21*a*, of the electrical board 21. As illustrated in FIG. 4, the solution holding container 22 has a bottomed cylindrical shape whose upper surface is open. An opening 22*a* which serves as a solution outlet at the center position is formed in a bottom portion of the solution holding container 22. An opening area of an upper surface opening 22*b* is larger than an opening area of the opening 22*a* serving as the solution outlet.

As illustrated in FIG. 3, a rectangular opening 21*c* which is a through-hole larger than the opening 22*a* serving as the solution outlet of the solution holding container 22 is formed in the electrical board 21. As illustrated in FIG. 4, a bottom portion of the solution holding container 22 is bonded and fixed to the first surface 21*a* of the electrical board 21 so that the opening 22*a* serving as the solution outlet of the solution holding container 22 is located inside the opening 21*c* of the electrical board 21.

An electrical board wiring 24 is patterned on a rear surface side, also referred to as a second surface 21*b*, of the electrical board 21. The electrical board wiring 24 has two wiring patterns 24*a* and 24*b* which are respectively connected to a terminal portion 131*c* of a lower electrode 131 and a terminal portion 133*c* of an upper electrode 133.

One end portion of the electrical board wiring 24 has an electrical signal input terminal 25 for inputting an electrical signal, also referred to as a drive signal, from the drive circuit 11. The other end portion of the electrical board wiring 24 includes an electrode terminal connector 26. The electrode terminal connector 26 is connected to the lower electrode terminal portion 131*c* and the upper electrode terminal portion 133*c* which are formed in the droplet ejecting array 27 illustrated in FIG. 5.

The droplet ejecting array 27 illustrated in FIG. 5 covers the opening 22*a* of the solution holding container 22, and is bonded and fixed to a lower surface of the solution holding container 22. The droplet ejecting array 27 is disposed at a position corresponding to the opening 21*c* of the electrical board 21.

As illustrated in FIG. 6, the droplet ejecting array 27 has a nozzle plate 100 and a pressure chamber structure 200 which are stacked on each other. The nozzle plate 100 includes an actuator 101 having a nozzle 110 for ejecting a solution, a lower electrode wiring portion 131*b*, a terminal portion 131*c*, an upper electrode wiring portion 133*b*, and a terminal portion 133*c*. In these examples, a plurality of the actuators 101 having a nozzle 110 as illustrated in FIG. 5 are arranged in three by three rows, for example. A center distance dl between the adjacent nozzles is 250 μm.

As illustrated in FIG. 7, the actuator 101 includes a diaphragm 120, a drive element 130, an insulating film 140, a protective film 150, a fluid repellent film 160, and the nozzle 110. For example, the diaphragm 120 may be integrated with the pressure chamber structure 200. For example, when the chamber structure 200 is manufactured on a silicon wafer 201 by a heat treatment in an oxygen atmosphere, a $SiO_2$ (silicon oxide) film is formed on a surface of the silicon wafer 201. The diaphragm 120 may be the $SiO_2$ (silicon oxide) film in which the silicon wafer 201 formed through the heat treatment in the oxygen atmosphere has the surface thickness of 4 μm. The diaphragm 120 may be formed using a chemical vapor deposition (CVD) method by depositing the $SiO_2$ (silicon oxide) film on the surface of the silicon wafer 201. The diaphragm 120 includes the nozzle 110 having a diameter of 20 μm.

It is preferable that the film thickness of the diaphragm 120 is within a range of 1 to 30 μm. The diaphragm 120 may be of a semiconductor material such as a SiN (silicon nitride) or $Al_2O_3$ (aluminum oxide).

The drive element 130 has an annular shape surrounding the nozzle 110. A shape of the drive element 130 is not limited, and may be a C-shape obtained by partially cutting the annular shape, for example. The drive element 130 illustrated in FIG. 7 includes an electrode portion 131*a* of the lower electrode 131 and an electrode portion 133*a* of the upper electrode 133, interposing a piezoelectric film 132 serving as a piezoelectric body. The electrode portion 131*a*, the piezoelectric film 132, and the electrode portion 133*a* are coaxial with the nozzle 110, and circular having similar diameters.

The lower electrode 131 includes a plurality of circular electrode portions 131*a* each coaxial with the nozzles 110. For example, the nozzle 110 may have a diameter of 20 μm, the electrode portion 131*a* may have an outer diameter of 133 μm and an inner diameter of 42 μm. As illustrated in FIG. 5, the lower electrode 131 includes a wiring portion 131*b* which connects the plurality of electrode portions 131*a* to one other. An end portion of the wiring portion 131*b* includes a terminal portion 131*c*.

The drive element 130 includes the piezoelectric film 132 formed of a piezoelectric material having the thickness of 2 μm, for example, on the electrode portion 131*a* of the lower electrode 131. The piezoelectric film 132 may be formed of PZT ($Pb(Zr, Ti)O_3$: lead titanate zirconate). For example, the piezoelectric film 132 is coaxial with the nozzle 110, and has an annular shape whose outer diameter is 133 μm and inner diameter is 42 μm, which is the same shape as the shape of the electrode portion 131*a* of the lower electrode 131. The film thickness of the piezoelectric film 132 is set to a range of approximately 1 to 5 μm. For example, the piezoelectric film 132 may be of a piezoelectric material such as PTO ($PbTiO_3$: lead titanate), PMNT ($Pb(Mg_{1/3}Nb_{2/3})O_3$—$PbTiO_3$), PZNT ($Pb(Zn_{1/3}Nb_{2/3})O_3$—$PbTiO_3$), ZnO, and AlN.

The piezoelectric film 132 generates polarization in a thickness direction. If an electric field in a direction the same as that of the polarization is applied to the piezoelectric film 132, the piezoelectric film 132 expands and contracts in a direction orthogonal to an electric field direction. In other words, the piezoelectric film 132 contracts or expands in a direction orthogonal to the film thickness.

The upper electrode 133 of the drive element 130 is coaxial with the nozzle 110 on the piezoelectric film 132, and has an annular shape whose outer diameter is 133 μm and inner diameter is 42 μm, which is the same shape as the shape of the piezoelectric film 132. As illustrated in FIG. 5, the upper electrode 133 includes a wiring portion 133*b* which connects the plurality of the electrode portions 133*a* to one another. An end portion of the wiring portion 133*b* includes a terminal portion 133*c*.

For example, the lower electrode 131 may be formed with a thickness of 0.5 μm by stacking Ti (titanium) and Pt (platinum) using a sputtering method. The film thickness of the lower electrode 131 is in a range of approximately 0.01 to 1 μm. The lower electrode 131 may be of other materials such as Ni (nickel), Cu (copper), Al (aluminum), Ti (titanium), W (tungsten), Mo (molybdenum), Au (gold), and $SrRuO_3$ (strontium ruthenium oxide). The lower electrode 131 may also be of various stacked metal materials.

The upper electrode 133 is formed of a Pt thin film. The thin film is formed using a sputtering method, and the film thickness is set to 0.5 μm. As other electrode materials of the upper electrode 133, Ni, Cu, Al, Ti, W, Mo, Au, and $SrRuO_3$ can be used. As another film formation method, vapor deposition and plating can be used. The upper electrode 133 may be of various stacked metal materials. The desirable film thickness of the upper electrode 133 is 0.01 to 1 μm.

The actuator 101 includes the insulating film 140 which insulates the lower electrode 131 and the upper electrode 133 from each other. For example, $SiO_2$ (silicon oxide) having the thickness of 0.5 μm is used for the insulating film 140. In a region proximate to the drive element 130, the insulating film 140 covers the periphery of the electrode portion 131*a*, the piezoelectric film 132, and the electrode portion 133*a*. The insulating film 140 covers the wiring portion 131*b* of the lower electrode 131. The insulating film 140 covers the diaphragm 120 in the region of the wiring portion 133*b* of the upper electrode 133. The insulating film 140 includes a contact portion 140*a* which electrically connects the electrode portion 133*a* and the wiring portion 133*b* of the upper electrode 133 to each other.

For example, the actuator 101 includes a protective film 150 formed of polyimide, which protects the drive element 130. The nozzle 110 is formed so as to communicate with the diaphragm 120 and the protective film 150.

The protective film 150 may be of other insulating materials such as other resins or ceramics. Examples of other resins include ABS (acrylonitrile butadiene styrene), polyacetal, polyamide, polycarbonate, and polyether sulfone. For example, ceramics include zirconia, silicon carbide, and silicon nitride. The film thickness of the protective film 150 is in a range of approximately 0.5 to 50 μm.

The actuator 101 includes a fluid repellent film 160 which covers the protective film 150. The fluid repellent film 160 is formed, for example, by spin-coating a silicone resin having a property of repelling a solution, for example. The fluid repellent film 160 can also be formed of a material having a property of repelling the solution, such as a fluorine-containing resin. The thickness of the fluid repellent film 160 is in a range of approximately 0.5 to 5 μm.

The pressure chamber structure 200 is formed using silicon wafer 201 having the thickness of 525 μm, for example. The pressure chamber structure 200 includes a warp reduction film 220 serving as a warp reduction layer on a surface opposite to the diaphragm 120. The pressure chamber structure 200 includes a pressure chamber 210 which penetrates the warp reduction film 220, reaches a position of the diaphragm 120, and communicates with the nozzle 110. The pressure chamber 210 is formed in a circular shape having the diameter of 190 μm which is located coaxially with the nozzle 110, for example. The shape and size of the pressure chamber 210 are not limited.

However, in the embodiment described herein, the pressure chamber 210 includes an opening which communicates with the opening 22*a* of the solution holding container 22. It is preferable that a size L in a depth direction of the pressure chamber 210 is larger than a size D in a width direction of the opening of the pressure chamber 210. Accordingly, due to the oscillation of the actuator 101, the pressure applied to the solution contained in the pressure chamber 210 is delayed in escaping to the solution holding container 22.

A side on which the diaphragm 120 of the pressure chamber 210 is disposed is referred to as a first surface of the pressure chamber structure 200, and a side on which the warp reduction film 220 is disposed is referred to as a second surface. The solution holding container 22 is bonded to the warp reduction film 220 side of the pressure chamber structure 200 by using an epoxy adhesive, for example. The pressure chamber 210 of the pressure chamber structure 200 communicates with the opening 22*a* of the solution holding container 22 through the opening on the warp reduction film 220 side. An opening area of the opening 22*a* of the solution holding container 22 is larger than a total area of openings of the pressure chamber 210 connecting to the opening 22*a* of the solution holding container 22.

For example, the warp reduction film 220 may be formed in such a way that the silicon wafer 201 is subjected to heat treatment in an oxygen atmosphere, and employs the $SiO_2$ (silicon oxide) film (having a thickness of 4 μm) which is formed on the surface of the silicon wafer 201. The warp reduction film 220 may also be formed by depositing a $SiO_2$ (silicon oxide) film on the surface of the silicon wafer 201 using a chemical vapor deposition method (CVD method). The warp reduction film 220 reduces warp occurring in the droplet ejecting array 27.

The warp reduction film 220 is on the side opposite to the side where the diaphragm 120 is formed on the silicon wafer 201 and reduces the warp of the silicon wafer 201. The warp reduction film 220 reduces the warp of the silicon wafer 201 which is caused by a difference in film stress between the pressure chamber structure 200 and the diaphragm 120 and further a difference in film stress between various configuration films of the drive element 130. The warp reduction film 220 reduces the warp of the droplet ejecting array 27 if the droplet ejecting array 27 is prepared using a deposition process.

The material and the film thickness of the warp reduction film 220 may be different from those of the diaphragm 120. However, if the warp reduction film 220 employs the material and the film thickness which are the same as those of the diaphragm 120, the difference in the film stress between the diaphragms 120 on both sides of the silicon wafer 201 is the same as the difference in the film stress between the warp reduction films 220. If the warp reduction film 220 employs the material and the film thickness which are the same as those of the diaphragm 120, the warp occurring in the droplet ejecting array 27 may be more effectively reduced.

If an electrical signal, also referred to as a drive signal, is sent to the actuator 101, the actuator 101 deforms in the thickness direction, and changes the volume of the pressure chamber 210 in response to the electrical signal, thereby causing pressure oscillation in the solution. In this manner, the nozzle 110 ejects the solution contained in the pressure chamber 210.

An example of a manufacturing method of the droplet ejecting array 27 will be described. In the droplet ejecting array 27, the $SiO_2$ (silicon oxide) film is first formed on both entire surfaces of the silicon wafer 201 for forming the pressure chamber structure 200. The $SiO_2$ (silicon oxide) film formed on one surface of the silicon wafer 201 is used as the diaphragm 120. The $SiO_2$ (silicon oxide) film formed on the other surface of the silicon wafer 201 is used as the warp reduction film 220.

For example, the $SiO_2$ (silicon oxide) films are formed on both surfaces of the disc-shaped silicon wafer 201 using a thermal oxidation method in which heat treatment is performed in an oxygen atmosphere using a batch type reaction furnace. Next, the plurality of nozzle plates 100 and pressure chambers 210 are formed on the disc-shaped circular silicon wafer 201 using a deposition process. After the nozzle plate 100 and the pressure chamber 210 are formed, the disc-shaped silicon wafer 201 is cut and separated into the plurality of pressure chamber structures 200 integrated with the nozzle plate 100. The plurality of droplet ejecting arrays 27 can be mass-produced at once using the disc-shaped silicon wafer 201. The silicon wafer 201 may not have a disc shape. A rectangular silicon wafer 201 may be used so as to separately form the nozzle plate 100 and the pressure chamber structure 200 which are integrated with each other.

The diaphragm 120 formed on the silicon wafer 201 is patterned using an etching mask so as to form the nozzle 110. The patterning may use a photosensitive resist as a material of the etching mask. After the photosensitive resist is coated on the surface of the diaphragm 120, exposure and development are performed to form the etching mask in which the opening corresponding to the nozzle 110 is patterned. The diaphragm 120 is subjected to dry etching from above the etching mask until the dry etching reaches the pressure chamber structure 200 so as to form the nozzle 110. After the nozzle 110 is formed in the diaphragm, the etching mask is removed using a stripping solution, for example.

Next, the drive element 130, the insulating film 140, the protective film 150, and the fluid repellent film 160 are formed on the surface of the diaphragm 120 having the nozzle 110 formed thereon. In forming the drive element 130, the insulating film 140, the protective film 150, and the fluid repellent film 160, a film forming process and a patterning process are repeatedly performed. The film forming process is performed using a sputtering method, a CVD method, or a spin coating method. For example, the patterning is performed in such a way that the etching mask is formed on the film using the photosensitive resist and the etching mask is removed after the film material is etched.

The materials of the lower electrode 131, the piezoelectric film 132, and the upper electrode 133 are stacked on the diaphragm 120 so as to form a film. As the material of the lower electrode 131, a Ti (titanium) film having the film thickness of 0.05 μm and a Pt (platinum) film having the film thickness of 0.45 μm are sequentially formed using a sputtering method. The Ti (titanium) and Pt (platinum) films may be formed using a vapor deposition method or by means of plating.

As the material of the piezoelectric film 132, PZT ($Pb(Zr, Ti)O_3$: lead titanate zirconate) having a film thickness of 2 μm is deposited on the lower electrode 131 using an RF magnetron sputtering method at the board temperature of 350° C. When the PZT film is subjected to heat treatment at 500° C. for 3 hours after the PZT film is formed, the PZT film can obtain satisfactory piezoelectric performance. The PZT film may also be formed using a chemical vapor deposition (CVD) method, a sol-gel method, an aerosol deposition (AD) method, or a hydrothermal synthesis method.

As the material of the upper electrode 133, the Pt (platinum) film having the film thickness of 0.5 μm is formed on the piezoelectric film 132 using a sputtering method. Using an etching mask by which the electrode portion 133*a* of the upper electrode 133 and the piezoelectric film 132 are left on the deposited Pt (platinum) film, the exposed (unmasked) portions of the Pt (platinum) and PZT ($Pb(Zr, Ti)O_3$: lead titanate zirconate) films are etched while the lower electrode 131 is left, thereby forming the electrode portion 133*a* of the upper electrode 133 and the patterned piezoelectric film 132.

Next, using an etching mask by which the electrode portion 131*a* of the lower electrode 131, the wiring portion 131*b*, and the terminal portion 131*c* are left on the material of the lower electrode 131 on which the electrode portion 133*a* of the upper electrode 133 and the piezoelectric film 132 are already formed, the exposed (unmasked) portions of the Ti (titanium) and Pt (platinum) films are removed so as to form the lower electrode 131.

As the material of the insulating film 140, the $SiO_2$ (silicon oxide) film having the film thickness of 0.5 μm is formed on the diaphragm 120 on which the lower electrode 131, the electrode portion 133*a* of the upper electrode 133, and the piezoelectric film 132 have been formed. For example, the $SiO_2$ (silicon oxide) film may be formed at low temperature using the CVD method so as to obtain satisfactory insulating performance. The $SiO_2$ (silicon oxide) film is patterned so as to form the insulating film 140.

As the material of the wiring portion 133*b* and the terminal portion 133*c* of the upper electrode 133, Au (gold) having the film thickness of 0.5 μm is formed using a sputtering method on the diaphragm 120 having the insulating film 140 formed thereon. The Au (gold) film may be formed using the vapor deposition method or the CVD method, or by means of plating. The etching mask by which the electrode wiring portion 133*b* and the terminal portion 133*c* of the upper electrode 133 are left is prepared on the deposited Au (gold) film. Etching is performed from above the etching mask, the Au (gold) film is removed so as to form the electrode wiring portion 133*b* and the terminal portion 133*c* of the upper electrode 133.

A polyimide film, which may be the material of the protective film 150 having the film thickness of 4 μm is formed on the diaphragm 120 having the upper electrode 133 formed thereon. The polyimide film is formed in such a way that a solution containing a polyimide precursor is coated on the diaphragm 120 using a spin coating method and thermal polymerization is performed by means of baking so as to remove a solvent. The formed polyimide film is patterned so as to form the protective film 150 which exposes the nozzle 110, the terminal portion 131*c* of the lower electrode 131, and the terminal portion 133*c* of the upper electrode 133.

A silicone resin film, which is the material of the fluid repellent film 160 in this example, is coated on the protective film 150 using a spin coating method so as to have the film thickness of 0.5 μm, and thermal curing is performed by means of baking so as to remove the solvent. The formed silicone resin film is then patterned so as to form the fluid repellent film 160, which exposes the nozzle 110, the terminal portion 131*c* of the lower electrode 131, and the terminal portion 133*c* of the upper electrode 133.

For example, a rear surface protective tape for chemical mechanical polishing (CMP) of the silicon wafer 201 may adhere onto the fluid repellent film 160 as a cover tape so as to protect the fluid repellent film 160 and the pressure chamber structure 200 can be patterned. The etching mask which exposes the pressure chamber 210 with the diameter of 190 μm is formed on the warp reduction film 220 of the silicon wafer 201. First, the warp reduction film 220 is subjected to dry etching using mixed gas of $CF_4$ (carbon tetrafluoride) and $O_2$ (oxygen). Next, for example, vertical deep dry etching preferentially for the silicon wafer is performed using mixed gas of $SF_6$ (sulfur hexafluoride) and $O_2$. The dry etching is stopped at a position in contact with the diaphragm 120, thereby forming the pressure chamber 210 in the pressure chamber structure 200.

The etching for forming the pressure chamber 210 may be performed by a wet etching method using a liquid etchant or a dry etching method using plasma. After the etching is completed, the etching mask is removed. A cover tape adhering onto the fluid repellent film 160 is irradiated with ultraviolet light so as to weaken adhesiveness therebetween, and the cover tape is detached from the fluid repellent film 160. The disc-shaped silicon wafer 201 is diced so as to separately form the plurality of droplet ejecting arrays 27.

Next, a manufacturing method of the droplet ejecting head 2 will be described. The droplet ejecting array 27 and the solution holding container 22 are bonded to each other. In this case, a bottom surface, on the same side as opening 22*a*, of the solution holding container 22 is bonded to the warp reduction film 220 of the pressure chamber structure 200 in the droplet ejecting array 27.

Thus, the solution holding container 22 bonded to the droplet ejecting array 27 is bonded to the first surface 21*a* of the electrical board 21 so that the opening 22*a* of the solution holding container 22 fits inside the opening 21*c* of the electrical board 21.

Subsequently, the electrode terminal connector 26 and the terminal portion 131*c* of the lower electrode 131 and the terminal portion 133*c* of the upper electrode 133 of the droplet ejecting array 27 are connected to each other by wiring 12. A connection method may be using a flexible cable. An electrode pad of the flexible cable can be connected to the electrode terminal connector 26. The terminal portion 131*c* and the terminal portion 133*c* may be electrically connected via an anisotropic conductive film formed by thermocompression bonding.

The electrical signal input terminal 25 on the electrical board wiring 24 has a shape which can come into contact with a leaf spring connector for inputting the electrical signal that is output from the drive circuit 11. In this manner, the droplet ejecting head 2 is formed.

Next, an operation of the above-described configuration will be described. The droplet ejecting head 2 is fixed to the droplet ejecting head mounting module 5 of the droplet ejecting apparatus 1. When the droplet ejecting head 2 is used, a predetermined amount of the solution is first supplied to the solution holding container 22 from the upper surface opening 22*b* of the solution holding container 22 by a pipette (not illustrated) or the like. The solution is held within the solution holding container 22. The opening 22*a* at the bottom portion of the solution holding container 22 communicates with the droplet ejecting array 27. Each pressure chamber 210 of the droplet ejecting array 27 is supplied with the solution from the solution holding container 22 via the opening 22*a* at the bottom surface of the solution holding container 22.

In this state, the electrical signal input from the drive circuit 11 to the electrical signal input terminal 25 of the electrical board wiring 24 is transmitted from the electrode terminal connector 26 of the electrical board wiring 24 to the terminal portion 131*c* of the lower electrode 131 and the terminal portion 133*c* of the upper electrode 133. In this case, the actuator 101 changes the volume of the pressure chamber 210 in response to the electrical signal, thereby causing pressure oscillation in the solution. In this manner, the solution contained in the pressure chamber 210 is ejected from the nozzle 110 as a solution droplet. A predetermined amount of the fluid is dropped into each well 4*b* of the microplate 4 from the nozzle 110.

The amount of one droplet ejected from the nozzle 110 is 2 to 5 picoliters. Therefore, the fluid dropping into each well 4*b* in the order of picoliters (pL) to microliters (μL) can be controlled by controlling the total number of droplets ejected into each well.

The length of the nozzle 110 is determined by the sum of the thickness of the diaphragm 120 and the thickness of the protective film 150. In the embodiment described herein, the length 8 μm is shown as an example. The length of the nozzle 110 is very short. Accordingly, if residual pressure oscillation remains in the solution contained in the pressure chamber 210 after the solution ejection operation is performed, an unintended solution droplet is ejected from the nozzle 110, the solution is dropped more than a target dropping amount.

Subsequently, an operation of the droplet ejecting head 2 will be described using several examples.

First Example

Figure 8:
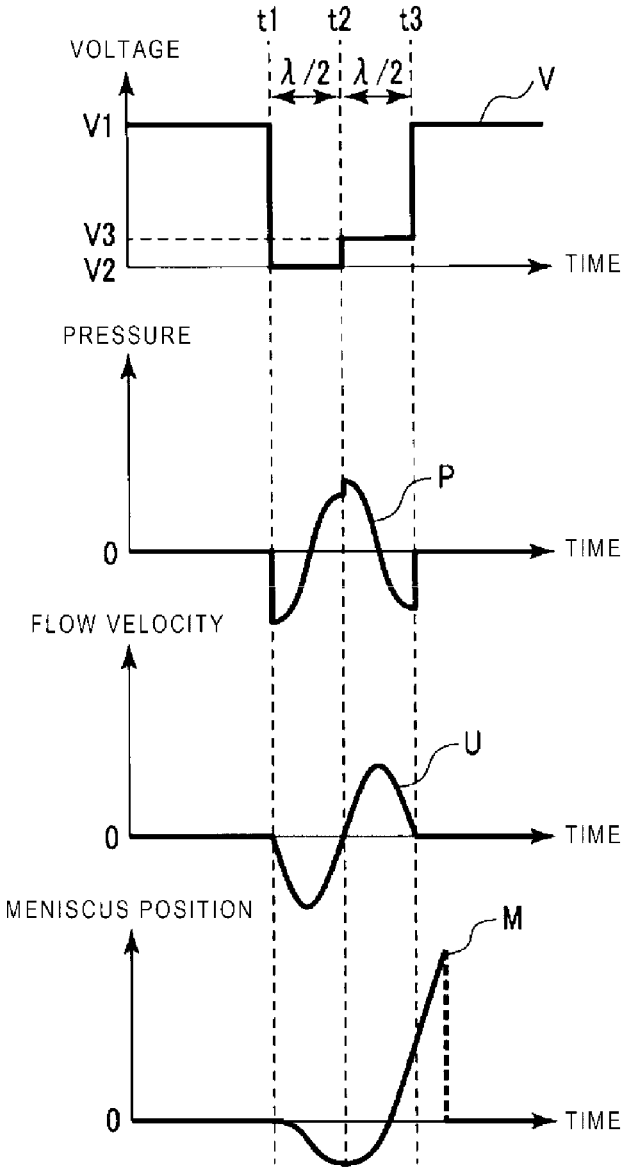
FIG. 8 is a graph according to a first example.

FIG. 8 illustrates a first example including an electrical signal V generated by the drive circuit 11 for the lower electrode 131, pressure oscillation P of the solution which is generated in the pressure chamber 210 by the electrical signal V, flow velocity oscillation U generated in the nozzle 110 by the pressure oscillation P, and a meniscus position M of the solution contained in the nozzle 110. Any pressure in the pressure oscillation P may also be referred to as pressure P. Any flow velocity in the flow velocity oscillation U may be referred to as flow velocity U. Here, the flow velocity U is defined as positive, greater than 0, in the solution ejecting direction. The meniscus position M is defined as zero at the opening surface of an outer edge of the nozzle 110. The meniscus position M is defined as positive, greater than 0, on the solution ejecting side (or outer side), in other words in the solution ejecting direction, and negative on the pressure chamber 210 side. The voltage of the upper electrode 133 is kept constant at 0 V.

A time period λ indicates the primary natural oscillation period of the actuator 101 when the pressure chamber 210 and the nozzle 110 are filled with the solution. The pressure P and the flow velocity U of the solution contained in the pressure chamber 210 and the nozzle 110 oscillate with this primary natural oscillation period λ.

The primary natural oscillation period λ can be measured by measuring the impedance of the actuator 101 while the droplet ejecting head 2 is filled with the solution using a commercially available impedance analyzer, such as a 4294A Precision Impedance Analyzer manufactured by Agilent Technologies, Inc. Alternatively, the primary natural oscillation period λ can be measured by measuring an oscillation of the actuator 101 while the electrical signal such as a step waveform is output from the drive circuit 11. Such oscillation can be measured by a commercially available laser Doppler vibrometer.

The solution is injected from the opening 22*a* of the solution holding container 22, and the droplet ejecting head 2 waits for solution ejecting in a state where the pressure chamber 210 and the nozzle 110 are internally filled with the solution. In this state, the meniscus position M of the solution contained in the nozzle 110 is stationary around zero.

The electrical signal V remains at a first voltage V1 in a standby state before start timing t1 for the solution ejecting operation.

In this standby state, the first voltage V1 is applied between the lower electrode 131 and the upper electrode 133, and an electric field is applied in the thickness direction of the piezoelectric film 132. Deformation occurs in the piezoelectric film 132 in a $d_{31}$ mode (in the thickness direction), and the piezoelectric film 132 contracts in the direction orthogonal to the thickness direction. The contraction of the piezoelectric film 132 causes compressive stress in the diaphragm 120 and the protective film 150. However, the Young's modulus of the diaphragm 120 is greater than the Young's modulus of the protective film 150. Accordingly, the compressive force in the diaphragm 120 is greater than the compressive force in the protective film 150. Therefore, the actuator 101 is curved toward the pressure chamber 210, and the volume of the pressure chamber 210 is smaller than that where the first voltage V1 is not applied. That is, as a voltage level of the electrical signal V increases, the volume of the pressure chamber 210 decreases due to the operation of the actuator 101.

At time t1, the solution ejecting operation starts. The electrical signal V is changed from the first voltage V1 to a second voltage V2.

The voltage V2 is lower than the voltage V1. The volume of the pressure chamber 210 increases and is larger than when the first voltage V1 is applied. The second voltage V2 is preferably 0 V or a slightly negative value that is a reversed polarity of the first voltage V1. However, if the second voltage V2 has a large negative voltage, the polarization direction of the piezoelectric film 132 is inverted from the standby state, and a desired operation cannot be obtained. Accordingly, it is desirable that the second voltage V2 is 0 V or a voltage which has the same polarity as the first voltage V1.

When the electrical signal V is changed from the first voltage V1 to the second voltage V2, the actuator 101 is deformed in the direction which increases the volume of the pressure chamber 210.

When the volume of the pressure chamber 210 increases, the pressure P of the solution contained in the pressure chamber 210 decreases, and the meniscus position M of the solution contained in the nozzle 110 moves toward the pressure chamber 210. The solution is supplied from the solution holding container 22 to the pressure chamber 210. The pressure P temporarily decreases, and subsequently increases.

After a half of the primary natural oscillation period λ/2 elapses from time t1 to time t2, the pressure P stops increasing. The meniscus position M of the solution stops moving towards the pressure chamber 210.

At this timing, the voltage of the electrical signal V is changed from the second voltage V2 to a third voltage V3. The third voltage V3 is equal to or greater than the second voltage V2, and is lower than the first voltage V1. The actuator 101 is deformed toward the pressure chamber 210, and the solution contained in the pressure chamber 210 is further pressurized. The meniscus position M of the solution starts to move in the solution ejecting direction, and the solution is ejected from the nozzle 110. The solution ejecting is continuously performed for a time period λ/2. During this time period, the pressure P decreases.

After another half of the primary natural oscillation period λ/2 elapses from time t2 to time t3, the pressure P is minimized. The flow velocity U of the solution contained in the nozzle 110 becomes zero, and the solution ejecting is stopped. However, the solution already ejected from the nozzle 110 forms a droplet and continues to fly.

At this timing, the voltage of the electrical signal V is changed from V3 to V1. The actuator 101 is deformed towards the pressure chamber 210, and the pressure P of the solution contained in the pressure chamber 210 is pressurized at a negative pressure to substantially zero, and the solution stops oscillating. In this way, the solution oscillation generated at time t1 stops after being canceled by the deformation of the actuator 101 at time t3. Therefore, at time t3, the pressure P and the flow velocity U become zero.

Even after time t3, the solution droplet that has been ejected from the nozzle 110 continues to fly toward the well 4*b* of the microplate 4. As the solution droplet flies, the tail of the solution droplet is spontaneously separated from the solution contained in the nozzle 110, and the solution meniscus is reformed in the vicinity of the meniscus position M of zero.

The third voltage V3 is determined according to the attenuation rate of the pressure oscillation P or the flow velocity oscillation U of the solution. The attenuation rate of the pressure oscillation P and the attenuation rate of flow velocity oscillation U have the same value. The attenuation rate can be calculated simultaneously with the measurement of the primary natural oscillation period λ. If the attenuation rate is high, a ratio of the voltage (V1−V3) to the voltage (V1−V2) is set to be low. That is, the third voltage V3 is set to be high. If the attenuation rate is low, a ratio of the voltage (V1−V3) to the voltage (V1−V2) is set to be high. That is, the third voltage V3 is set to be low. The third voltage V3 is adjusted so that the pressure oscillation P or the flow velocity oscillation U after time t3 is minimized or substantially becomes zero. If the attenuation rate is small in a low viscosity solution, the attenuation rate may be regarded as zero, and the third voltage V3 may be equal to the second voltage V2.

Figure 9:
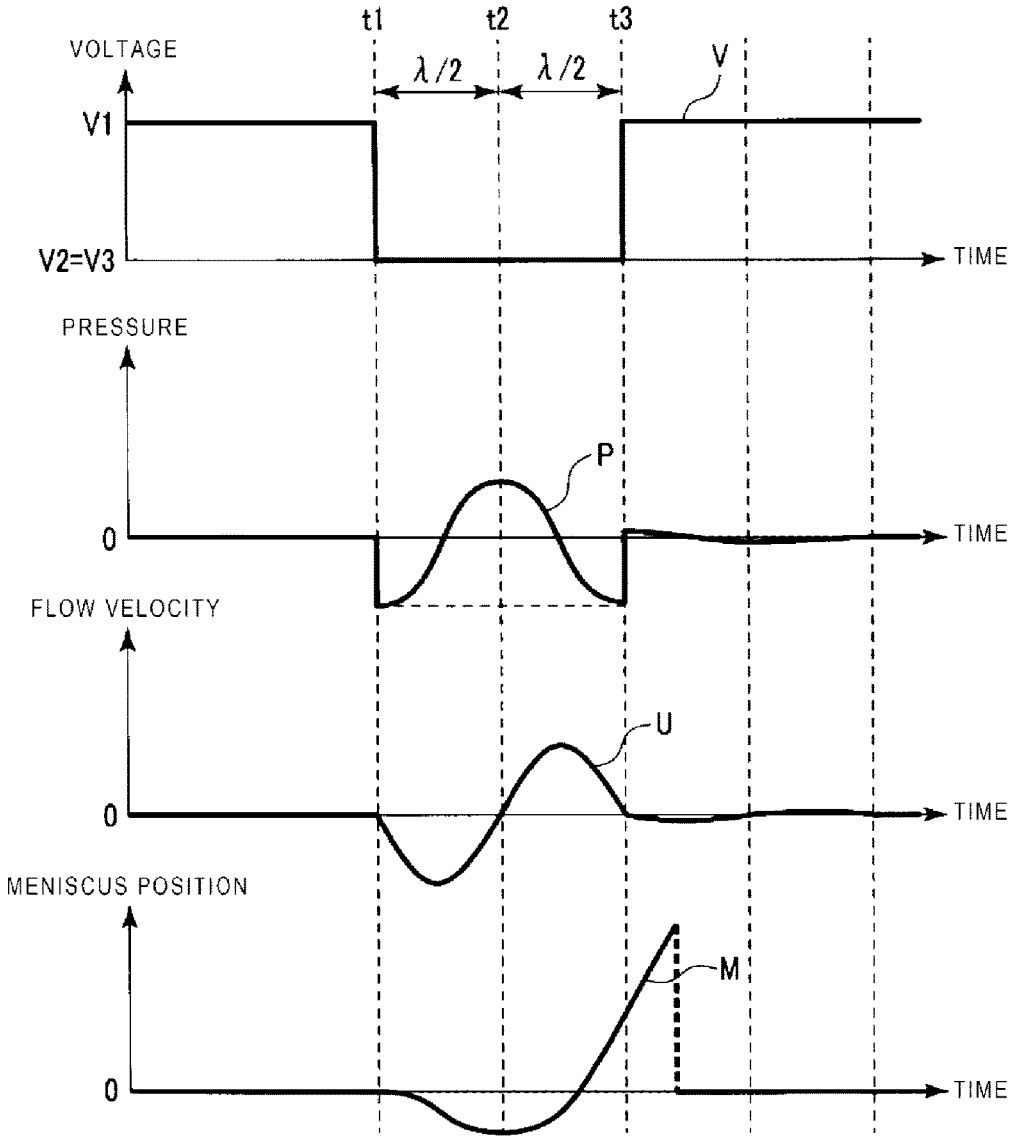
FIG. 9 is a graph when a third voltage V3 is equal to a second voltage V2 according to the first example.

FIG. 9 illustrates the first example when the third voltage V3 is equal to the second voltage V2, which includes the electrical signal V generated by the drive circuit 11 for the lower electrode 131, the solution pressure oscillation P generated in the pressure chamber 210 by the electrical signal V, the flow velocity oscillation U generated in the nozzle 110 by the pressure oscillation P, and the meniscus position M of the solution contained in the nozzle 110.

As described above, the electrical signal V includes the first voltage V1, the second voltage V2 which increases the volume of the pressure chamber 210 more than the first voltage V1, and the third voltage V3 which is in a range between the first voltage V1 and the second voltage V2, or equal to the second voltage V2. The electrical signal V is changed from the first voltage V1 to the second voltage V2, and is changed from the third voltage V3 to the first voltage V1 after a time period λ elapses so as to eject one solution droplet from the nozzle 110. After the electrical signal V is changed from the first voltage V1 to the second voltage V2, the electrical signal V remains at the second voltage V2 for a time period λ/2, and then is changed from the second voltage V2 to the third voltage V3. The electrical signal V remains at the third voltage V3 for the time period λ/2 after the second voltage V2 is changed to the third voltage V3.

In this way, immediately after the solution is completely ejected from the nozzle 110, the solution pressure oscillation P and the flow velocity oscillation U are stopped. Accordingly, unintended ejections of the solution from the nozzle 110 due to residual oscillation of the solution after the solution ejection operation can be prevented.

If the solution meniscus is reformed at a position closer to the pressure chamber 210 than the position in the standby state position, the solution meniscus moves forward in the solution ejection direction due to the surface tension of the solution or the like, and thus unintended solution is ejected from the nozzle 110. However, according to the embodiment described herein, the solution meniscus is reformed in the vicinity of the position in the standby state before the solution ejection operation is performed. Accordingly, the solution meniscus after being reformed is brought into a substantially stationary state. Therefore, even after the solution is ejected at high ejecting speed, the unintended solution is not ejected even the nozzle 110 is provided on an actuator 101, and the target solution amount can be accurately dropped in a shorter period of time.

Second Example

Figure 10:
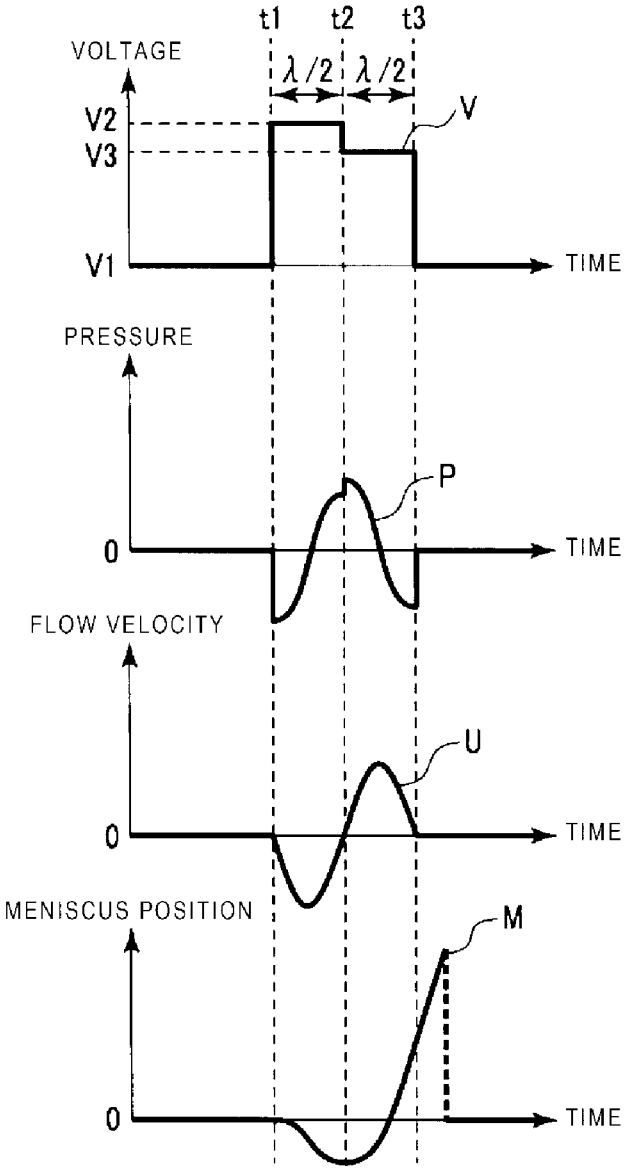
FIG. 10 is a graph according to a second example.

FIG. 10 illustrates a second example which includes the electrical signal V, the pressure oscillation P, the flow velocity oscillation U, and the meniscus position M in the same manner as that in the first example. In the second example, the first voltage V1 is 0 V. The voltage of the upper electrode 133 is kept constant at V2. Hereinafter, points different from those of the first example will be mainly described.

If a voltage is applied between the lower electrode 131 and the upper electrode 133, the actuator 101 is deformed towards the pressure chamber 210, and the volume of the pressure chamber 210 is smaller than that where no voltage is applied therebetween. Therefore, as the value of the electrical signal V increases, the volume of the pressure chamber 210 increases due to the operation of the actuator 101.

The electrical signal V remains at the first voltage V1 (0 V) in the standby state before start timing t1 for the solution ejecting operation. At time t1, the electrical signal V is changed from the first voltage V1 to the second voltage V2. The second voltage V2 is higher than the first voltage V1. After the time period λ/2 elapses from time t1 to time t2, the electrical signal V is changed from the second voltage V2 to the third voltage V3. The third voltage V3 is lower than the second voltage V2, and is higher than the first voltage V1. As described in the first example, the third voltage V3 may be equal to the second voltage V2. After the time period λ/2 elapses from time t2 to time t3, the electrical signal V is changed from the third voltage V3 to the first voltage V1.

An absolute value of the voltage difference between the upper electrode 133 and the lower electrode 131 is the same as that in the first example. Accordingly, the operation of the piezoelectric film 132 is the same as that in the first example. Therefore, the pressure oscillation P, the flow velocity oscillation U, and the meniscus position M are respectively the same as the pressure oscillation P, the flow velocity oscillation U, and the meniscus position M in the first example.

As described above, the electrical signal V includes the first voltage V1, the second voltage V2 which increases the volume of the pressure chamber 210 than the first voltage V1, and the third voltage V3 which is in a range between the first voltage V1 and the second voltage V2, or which is equal to the second voltage V2. The electrical signal V is changed from the first voltage V1 to the second voltage V2, and is changed from the third voltage V3 to the first voltage V1 after the time period λ elapses so as to eject one solution droplet from the nozzle 110. After the electrical signal V is changed from the first voltage V1 to the second voltage V2, the electrical signal V remains at the second voltage V2 for the time period λ/2, and is changed from the second voltage V2 to the third voltage V3. The electrical signal V remains at the third voltage V3 for the time period λ/2 after the second voltage V2 is changed to the third voltage V3. Since the second example has the operations which are the same as those in the first example, description thereof will be omitted.

Third Example

Figure 11:
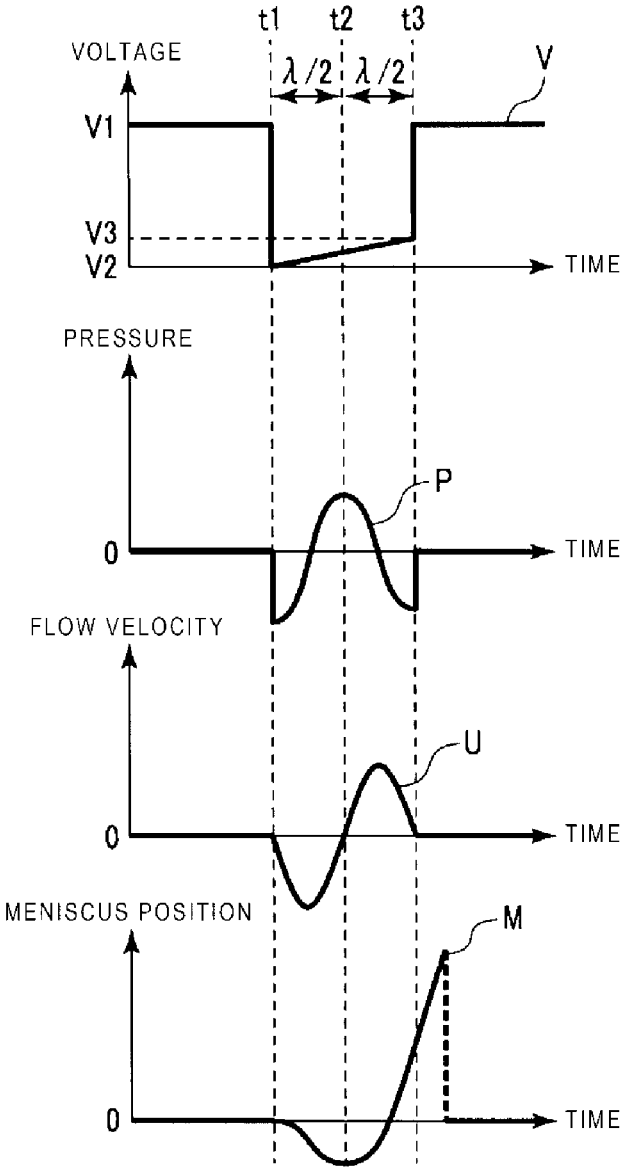
FIG. 11 is a graph according to a third example.

FIG. 11 illustrates a third example which includes the electrical signal V, the pressure oscillation P, the flow velocity oscillation U, and the meniscus position M, similarly to the first example. As in the first example, the voltage of the upper electrode 133 is kept constant at 0 V. Hereinafter, points different from those of the first example will be mainly described.

At time t1, when the electrical signal V is changed from the first voltage V1 to the second voltage V2, the diaphragm 120 is deformed in the direction which increases the volume of the pressure chamber 210.

When the volume of the pressure chamber 210 increases, the pressure P of the solution contained in the pressure chamber 210 decreases, and the meniscus position M of the solution contained in the nozzle 110 moves toward the pressure chamber 210. The solution is supplied from the solution holding container 22 to the pressure chamber 210. The pressure P temporarily decreases, and subsequently increases.

The electrical signal V consecutively increases from the second voltage V2 to the third voltage V3 until time t3 after time t1 elapses. As a result, the volume of the pressure chamber 210 gradually contracts. However, a change rate in the volume of the pressure chamber 210 is small. Therefore, the fluctuation of the pressure P and the flow velocity U caused by the contracting operation is small, and thus, can be negligible.

When the time period λ/2 elapses from time t1 to time t2, the pressure P stops increasing. The meniscus position M of the solution stops moving toward the pressure chamber 210. The meniscus position M of the solution starts to move forward in the solution ejecting direction, and the solution is ejected from the nozzle 110. The solution ejecting is continuously performed for the time period λ/2. During this time period, the pressure P decreases.

When the time period λ/2 elapses from time t2 to time t3, the pressure P is minimized. The flow velocity U of the solution contained in the nozzle 110 becomes zero, and the solution ejecting is stopped. However, the solution already ejected from the nozzle 110 forms a droplet and continues to fly.

At this timing, the voltage of the electrical signal V is changed from V3 to V1. The actuator 101 is deformed toward the pressure chamber 210, and the pressure P of the solution contained in the pressure chamber 210 is pressurized in a state of negative pressure to substantially zero, and the solution stops oscillating. In this way, the solution oscillation generated at time t1 stops after being canceled by the deformation of the actuator 101 at time t3. Therefore, at time t3, the pressure P and the flow velocity U become zero.

Even after time t3, the solution droplet that has been ejected from the nozzle 110 continues to fly toward the well 4*b* of the microplate 4. As the solution droplet flies, the tail of the solution droplet is spontaneously separated from the solution contained in the nozzle 110, and the solution meniscus is reformed in the vicinity of the meniscus position M of zero.

As described above, the electrical signal V includes the first voltage V1, the second voltage V2 which increases the volume of the pressure chamber 210 than the first voltage V1, and the third voltage V3 which is in a range between the first voltage V1 and the second voltage V2, or which is equal to the second voltage V2. The electrical signal V is changed from the first voltage V1 to the second voltage V2, and is changed from the third voltage V3 to the first voltage V1 after the time period λ elapses so as to eject one solution droplet from the nozzle 110. After the electrical signal V is changed from the first voltage V1 to the second voltage V2, the second voltage V2 is gradually changed to the third voltage V3 throughout the time period λ.

In this way, in the third example, unintended ejections of the solution from the nozzle 110 due to residual oscillation after the solution ejection operation can also be prevented.

The solution meniscus is reformed in the vicinity of the position in the standby state before the solution ejecting operation is performed. Accordingly, the solution meniscus after being reformed is brought into a substantially stationary state. Therefore, even after the solution is ejected at high ejecting speed, the unintended solution is not ejected even the nozzle 110 is provided on an actuator 101, and the target solution amount can be accurately dropped in a shorter period of time.

Similarly to the first example, the third voltage V3 is determined according to the attenuation rate of the pressure oscillation P or the flow velocity oscillation U of the solution.

Even in the second example described above, the electrical signal V may also consecutively decrease from the second voltage V2 to the third voltage V3 until time t3 after time t1 elapses. Since the operation in this case is the same as the above-described operation in the third example, description thereof will be omitted.

Fourth Example

Figure 12:
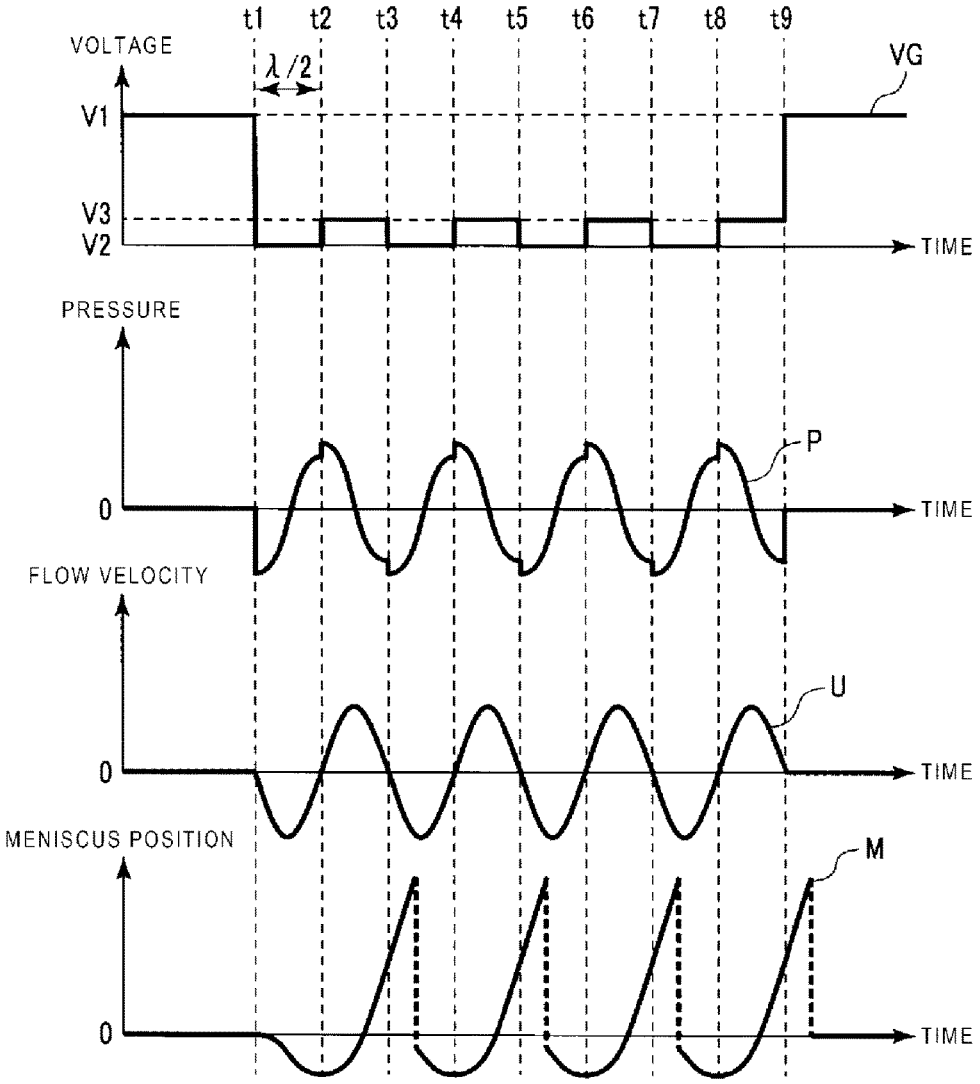
FIG. 12 is a graph according to a fourth example.

FIG. 12 illustrates a fourth example which includes an electrical signal VG generated by the drive circuit 11 for the lower electrode 131, the solution pressure oscillation P generated in the pressure chamber 210 by the electrical signal VG, the flow velocity oscillation U generated in the nozzle 110 by the pressure oscillation P, and the meniscus position M of the solution contained in the nozzle 110. The voltage of the upper electrode 133 is kept constant at 0 V. The description which is the same as that in the first example will be omitted.

In the fourth example, the electrical signal VG includes four repetitions of the electrical signal V according to the first example. This causes the nozzle 110 to consecutively eject four droplets of the solution droplet. The electrical signal VG may include other number of repetitions of the electrical signal V. The droplets of the solution are ejected into a well 4*b* of the microplate 4. By changing the number of repetitions of the electrical signal V, it is possible to control the number of droplets of the solution to be ejected, and thus it is possible to control the amount of solution to be dropped into the well 4*b* of the microplate 4.

The electrical signal VG remains at the first voltage V1 in the standby state before start timing t1 for the solution ejecting operation.

In this state, the volume of the pressure chamber 210 is smaller than that where the first voltage V1 is not applied therebetween. That is, as the value of the electrical signal VG increases, the volume of the pressure chamber 210 decreases due to the operation of the actuator 101.

At time t1, the solution ejecting operation starts. The electrical signal VG is changed from the first voltage V1 to a second voltage V2.

The second voltage V2 is lower than the first voltage V1. The voltage V2 increases the volume of the pressure chamber 210 more than the first voltage V1, and is preferably 0 V or a slightly negative value that is a reversed polarity of the first voltage V1.

When the electrical signal VG is changed from the first voltage V1 to the second voltage V2, the actuator 101 is deformed in the direction that increases the volume of the pressure chamber 210.

When the volume of the pressure chamber 210 increases, the pressure P of the solution contained in the pressure chamber 210 decreases, and the meniscus position M of the solution contained in the nozzle 110 moves back towards the pressure chamber 210. The solution is supplied from the solution holding container 22 to the pressure chamber 210. The pressure P temporarily decreases, and subsequently increases.

When the time period λ/2 elapses from time t1 to time t2, the pressure P stops increasing. The meniscus position M of the solution stops moving toward the pressure chamber 210.

At this time, the voltage of the electrical signal VG is changed from V2 to V3. The third voltage V3 is equal to or greater than the second voltage V2, and is lower than the first voltage V1. The actuator 101 is deformed toward the pressure chamber 210, and the solution contained in the pressure chamber 210 is further pressurized. The meniscus position M of the solution starts to move forward in the solution ejecting direction, and the solution is ejected from the nozzle 110. The solution ejecting is continuously performed for the time period λ/2. During this time period, the pressure P decreases.

When the time period λ/2 elapses from time t2 to time t3, the pressure P is minimized. The flow velocity U of the solution contained in the nozzle 110 becomes zero, and the solution ejecting is stopped. However, the solution already ejected from the nozzle 110 forms a droplet and continues to fly.

At time t3, the voltage of the electrical signal VG is changed from V3 to V2. The actuator 101 is deformed in the direction which increases the volume of the pressure chamber 210, and the pressure P of the solution contained in the pressure chamber 210 further decreases in a state of negative pressure and becomes a value same the one when the electrical signal VG is changed the first voltage V1 to the second voltage V2 at time t1. In this way, the amplitude of the fluctuation of due to the pressure oscillation P of the solution contained in the pressure chamber 210 is maintained at constant amplitude due to the change from the second voltage V2 to the third voltage V3 of the electrical signal VG and the change from the third voltage V3 to the second voltage V2. In this manner, the solution is replenished into the pressure chamber 210 during a period of time t3 to time t4, and the solution is ejected from the nozzle 110 during a period of time t4 to time t5.

This solution ejecting operation is further repeated twice from time t5 to time t9, and a total of four solution droplets are ejected from the nozzle 110.

At time t9, the pressure P is minimized. The flow velocity U of the solution contained in the nozzle 110 becomes zero, and the ejecting is stopped. However, the solution already ejected from the nozzle 110 forms a droplet and continues to fly.

At this time, the voltage of the electrical signal VG is changed from V3 to V1. The actuator 101 is deformed toward the pressure chamber 210, and the pressure P of the solution contained in the pressure chamber 210 is pressurized in a state of negative pressure to substantially zero, and the solution stops oscillating.

Even after time t9 elapses, the solution droplet ejected from the nozzle 110 continues to fly toward the well 4*b* of the microplate 4. As the solution droplet flies, the tail of the solution droplet is spontaneously separated from the solution contained in the nozzle 110, and the solution meniscus is reformed in the vicinity of the meniscus position M of zero.

The third voltage V3 is set so that the ejecting speed of the solution droplet to be consecutively ejected is as uniform as possible. Alternatively, similarly the first example, the third voltage V3 may be determined according to the attenuation rate of the pressure oscillation P or the flow velocity oscillation U of the solution.

As described above, the electrical signal VG can have the first voltage V1, the second voltage V2, which increases the volume of the pressure chamber 210 more than the first voltage V1, or the third voltage V3, which is in a range between the first voltage V1 and the second voltage V2, or which is equal to the second voltage V2. The electrical signal VG can be changed from the first voltage V1 to the second voltage V2, and can be changed from the third voltage V3 to the second voltage V2 after the time period λ elapses so as to eject one solution droplet from the nozzle 110. After this process is repeated as necessary, the third voltage V3 can be changed to the first voltage V1.

In this way, immediately after the solution is completely ejected from the nozzle 110, the solution pressure oscillation P and the flow velocity oscillation U are stopped. Accordingly, unintended ejections of the solution from the nozzle 110 due to residual oscillation after an intended ejection of the solution can be prevented.

The solution meniscus is reformed in the vicinity of its position during the stationary/stand-by state before the solution ejecting operation is performed. Accordingly, the solution meniscus after this reforming is brought into a substantially stationary state. Therefore, even after the solution has been ejected at a high ejecting speed, unintended solution is not ejected even the nozzle 110 is provided on an actuator 101, and the target solution amount can be accurately dropped in a shorter period of time.

In a drive waveform VG according to the fourth example, since the solution is consecutively ejected, the time required to drop the solution can be shortened, and unintended ejection of the solution from the nozzle 110 can be prevented. In addition to these advantageous effects, since the second and subsequent solution droplets are ejected using the pressure oscillation generated by the first ejecting operation, there is another advantageous effect in that electric energy required for the second and subsequent solution droplets can be reduced.

That is, if electrostatic capacitance between the lower electrode 131 and the upper electrode 133 is set to C and the second voltage V2 is set to zero, electric energy E1 required to eject the first droplet is $C \times V3^2 + C \times (V1 - V3)^2$. However, electric energy E2 required to eject the second and subsequent droplets is $C \times V3^2$. In many cases, the third voltage V3 is equal to or lower than 50% of the first voltage V1. Accordingly, the electric energy E2 required to eject the second and subsequent droplets is equal to or lower than approximately 50% of the electric energy E1 required to eject the first droplet.

Therefore, the power consumption of the droplet ejecting head 2 can be reduced, and the energy cost for driving the droplet ejecting apparatus can be reduced.

As described in the third example, the electrical signal VG may consecutively increase from the second voltage V2 to the third voltage V3. The electrical signal VG may be an example in which the electrical signal V of the second example is repeated multiple times. In this case, the electrical signal VG may consecutively decrease from the second voltage V2 to the third voltage V3 as described in the third example.

According to these examples, in the solution ejecting operation, the droplet ejecting head first causes the actuator to increase the volume of the pressure chamber so as to decrease the solution pressure. The solution is fed from the solution holding container into the pressure chamber. The solution pressure naturally increases due to a pressure oscillation. The solution is thus ejected from the nozzle. After the solution is ejected (and the solution pressure decreases in the pressure chamber accordingly), the actuator acts to decrease the volume of the pressure chamber and thus re-pressurizes the solution. In this manner, the solution pressure oscillation can be canceled concurrently with the completion of the solution ejecting so as to prevent unintended solution from being ejected. Therefore, it is possible to provide the droplet ejecting head which can accurately drop a target solution amount in a shorter period of time without ejecting the unintended solution after the solution has been ejected even at a high ejecting speed and which has a piezoelectric actuator including the nozzle, or the droplet ejecting apparatus including the droplet ejecting head.

While certain embodiments have been described, these embodiments have been presented by way of example only, and are not intended to limit the scope of the inventions.

Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

For example, the drive element 130 has a circular shape as depicted. However, the shape of the drive unit is not limited to a circular shape. The shape of the drive element 130 may be a rhombus shape or an elliptical shape, for example. Similarly, the shape of the pressure chamber 210 is not limited to a circular shape, and may be a rhombus shape, an elliptical shape, or a rectangular shape.

In the example embodiments, the nozzle 110 is disposed at the center of the drive element 130. However, the position of the nozzle 110 is not particularly limited as long as the solution of the pressure chamber 210 can be ejected from the nozzle 110. For example, the nozzle 110 may be formed outside the drive element 130, that is, not within an overlapping region of the drive element 130. If the nozzle 110 is disposed outside the drive element 130, the nozzle 110 does not need to be patterned by penetrating a plurality of film materials of the drive element 130. Likewise, the plurality of film materials of the drive element 130 do not need an opening patterning process to be performed at the position corresponding to the nozzle 110. The nozzle 110 can be formed by simply patterning the diaphragm 120 and the protective film 150. Therefore, the patterning process may be facilitated.

What is claimed is:

1. A droplet ejecting head, comprising:

a board having a first surface and a second surface;

a pressure chamber in the board and having an opening on a first surface side of the board through which a solution can be supplied to the pressure chamber;

a nozzle through which solution supplied from the pressure chamber can be ejected, the nozzle being disposed on a second surface side of the board opposite the first surface side;

an actuator configured to cause a pressure change in the pressure chamber in response to an electrical signal supplied from a drive circuit by changing a volume of the pressure chamber; and a solution holding container on the first surface side of the board, the solution holding container having a solution inlet for receiving solution and a solution outlet for supplying solution to the pressure chamber via the opening, wherein the drive circuit is configured to:

set the electrical signal at a first voltage level at a start of a droplet ejection process for ejecting solution through the nozzle, change the electrical signal from the first voltage level to a second voltage level during the droplet ejection process, set the electrical signal to a third voltage level during a time period after changing the electrical signal from the first voltage level to the second voltage level, the time period being equal to a primary natural oscillation period of the actuator when the pressure chamber and the nozzle are filled with solution, and set the electrical signal to the first voltage level after the time period has elapsed, the second voltage level when applied to actuator causing the pressure chamber to expand in volume from a volume of the pressure chamber when the first voltage level is applied to the actuator, and the third voltage level being in a range between the first voltage level and the second voltage level or equal to the second voltage level.

2. The droplet ejecting head according to claim 1, wherein the solution inlet is larger than the solution outlet, and the solution outlet is larger than the opening of the pressure chamber.

3. The droplet ejecting head according to claim 1, wherein solution is supplied to the pressure chamber from the solution holding container when the drive circuit changes the electrical signal from the first voltage level to the second voltage level, solution in the pressure chamber is ejected from the nozzle after an elapse of one half of the time period after the drive circuit has changed the electrical signal from the first voltage level to the second voltage level, and ejection of solution from the nozzle is stopped upon an elapse of one time period after drive circuit has changed the electrical signal from the first voltage level to the second voltage level.

4. The droplet ejecting head according to claim 1, wherein the drive circuit is configured to change the electrical signal from the second voltage level to the third voltage level after an elapse of one half of the time period after the electrical signal has been changed from the first voltage level to the second voltage level.

5. The droplet ejecting head according to claim 4, wherein the second voltage level is not equal to the third voltage level.

6. The droplet ejecting head according to claim 1, wherein the drive circuit is configured to consecutively change the electrical signal from the second voltage level to the third voltage level during the time period after the electrical signal has been changed from the first voltage level to the second voltage level.

7. The droplet ejecting head according to claim 1, wherein the actuator comprises a piezoelectric film and the nozzle is integrated with the actuator.

8. A droplet ejecting head, comprising:

a board having a first surface and a second surface;

a pressure chamber in the board and having an opening on a first surface side of the board through which a solution can be supplied to the pressure chamber;

a nozzle through which solution supplied from the pressure chamber can be ejected, the nozzle being disposed on a second surface side of the board opposite the first surface side;

an actuator configured to cause a pressure change in the pressure chamber in response to an electrical signal supplied from a drive circuit by changing a volume of the pressure chamber; and a solution holding container on the first surface side of the board, the solution holding container having a solution inlet for receiving solution and a solution outlet for supplying solution to the pressure chamber via the opening, wherein the drive circuit is configured to, when a predetermined number of droplets of the solution is to be ejected from the nozzle, in a droplet ejection process:

set the electrical signal at a first voltage level at a start of the droplet ejection process for ejecting solution through the nozzle, change the electrical signal from the first voltage level to a second voltage level during the droplet ejection process, after changing the electrical signal from the first voltage level to the second voltage level at the start of the droplet ejection process, set the electrical signal to a third voltage level during each time period of ejecting one of the predetermined number of droplets, each time period being equal to a primary natural oscillation period of the actuator when the pressure chamber and the nozzle are filled with solution, in each time period of ejecting one of the predetermined number of droplets, set the electrical signal to the second voltage level from the third voltage level, and set the electrical signal to the first voltage level after a total number of time periods of ejecting one of the predetermined number of droplets equals the predetermined number of droplets, the second voltage level when applied to actuator causing the pressure chamber to expand in volume from a volume of the pressure chamber when the first voltage level is applied to the actuator, and the third voltage level being in a range between the first voltage level and the second voltage level or equal to the second voltage level.

9. The head according to claim 8, wherein the solution inlet is larger than the solution outlet, and the solution outlet is larger than the opening of the pressure chamber.

10. The droplet ejecting head according to claim 8, wherein solution is supplied to the pressure chamber from the solution holding container when the drive circuit changes the electrical signal from the first voltage level to the second voltage level or changes the electrical signal from the third voltage level to the second voltage level, solution in the pressure chamber is ejected from the nozzle after an elapse of one half of the time period after the drive circuit has changed the electrical signal from the first voltage level to the second voltage level or has changed the electrical signal from the third voltage level to the second voltage level, and ejection of solution from the nozzle is stopped upon an elapse of one time period after drive circuit has changed the electrical signal from the first voltage level to the second voltage level or has changed the electrical signal from the third voltage level to the second voltage level.

11. The droplet ejecting head according to claim 8, wherein the drive circuit is configured to change the electrical signal from the second voltage level to the third voltage level after an elapse of one half of the time period after the electrical signal has been changed from the first voltage level to the second voltage level or changed from the third voltage level to the second voltage level.

12. The droplet ejecting head according to claim 11, wherein the second voltage level is equal to the third voltage level.

13. The droplet ejecting head according to claim 8, wherein the drive circuit is configured to consecutively change the electrical signal from the second voltage level to the third voltage level during the time period after the electrical signal has been changed from the first voltage level to the second voltage level or changed from the third voltage level to the second voltage level.

14. A solution dispenser, comprising:

a base on which a multiwell plate can be disposed;

a droplet ejecting head having first surface side facing the base and a second surface side opposite the first surface side, the droplet ejecting head comprising:

a pressure chamber having an opening on the second surface side through which a solution can be supplied to the pressure chamber;

a nozzle on the first surface side through which solution supplied from the pressure chamber can be ejected onto the multiwell plate;

an actuator configured to cause a pressure change in the pressure chamber to control an ejection of solution in response to an electrical signal by changing a volume of the pressure chamber; and a solution holding container on the second surface side, the solution holding container having a solution inlet for receiving solution and a solution outlet for supplying solution to the pressure chamber via the opening; and a drive circuit configured to supply the electrical signal to the actuator, wherein the drive circuit is configured to:

set the electrical signal at a first voltage level at a start of a droplet ejection process for ejecting solution through the nozzle, change the electrical signal from the first voltage level to a second voltage level during the droplet ejection process, set the electrical signal to a third voltage level during a time period after changing the electrical signal from the first voltage level to the second voltage level, the time period being equal to a primary natural oscillation period of the actuator when the pressure chamber and the nozzle are filled with solution, and set the electrical signal to the first voltage level after the time period has elapsed, the second voltage level when applied to actuator causing the pressure chamber to expand in volume from a volume of the pressure chamber when the first voltage level is applied to the actuator, and the third voltage level being in a range between the first voltage level and the second voltage level or equal to the second voltage level.

15. The solution dispenser according to claim 14, wherein the solution inlet is larger than the solution outlet, and the solution outlet is larger than the opening of the pressure chamber.

16. The solution dispenser according to claim 14, wherein solution is supplied to the pressure chamber from the solution holding container when the drive circuit changes the electrical signal from the first voltage level to the second voltage level, solution in the pressure chamber is ejected from the nozzle after an elapse of one half of the time period after the drive circuit has changed the electrical signal from the first voltage level to the second voltage level, and ejection of solution from the nozzle is stopped upon an elapse of one time period after drive circuit has changed the electrical signal from the first voltage level to the second voltage level.

17. The solution dispenser according to claim 14, wherein the drive circuit is configured to change the electrical signal from the second voltage level to the third voltage level after an elapse of one half of the time period after the electrical signal has been changed from the first voltage level to the second voltage level.

18. The solution dispenser according to claim 17, wherein the second voltage level is equal to the third voltage level.

19. The solution dispenser according to claim 14, wherein the drive circuit is configured to consecutively change the electrical signal from the second voltage level to the third voltage level during the time period after the electrical signal has been changed from the first voltage level to the second voltage level.

20. The solution dispenser according to claim 14, wherein the actuator comprises a piezoelectric film and the nozzle is integrated with the actuator.

* * * * *